United States Patent [19]

Berger et al.

[11] 4,041,585

[45] Aug. 16, 1977

[54] HAND LOOM CONSTRUCTION

[76] Inventors: Phill R. Berger; Joan P. Berger, both of P.O. Box 393, Carmel Valley, Calif. 93924; Margery L. Magnani, 82 Fifth Ave., San Francisco, Calif. 94118

[21] Appl. No.: 646,656

[22] Filed: Jan. 5, 1976

[51] Int. Cl.[2] ..... D03D 29/00
[52] U.S. Cl. ..... 28/149
[58] Field of Search ..... 28/2, 15; 139/34

[56] References Cited

U.S. PATENT DOCUMENTS

| | | | |
|---|---|---|---|
| 2,305,613 | 12/1942 | Golden | 28/15 |
| 2,409,743 | 10/1946 | Durrin | 28/15 |
| 2,601,222 | 6/1952 | Wehrli | 28/15 |

*Primary Examiner*—Louis K. Rimrodt
*Attorney, Agent, or Firm*—S. L. Goldstein

[57] ABSTRACT

This invention is an improved hand loom made up of a heavy gauge wire which forms a base frame capable of being formed into a variety of different shaped outlines and encircling the base frame is a continuous coil of wire which encircles the base frame for movably holding the warp yarn conformed to the shaped outline.

4 Claims, 3 Drawing Figures

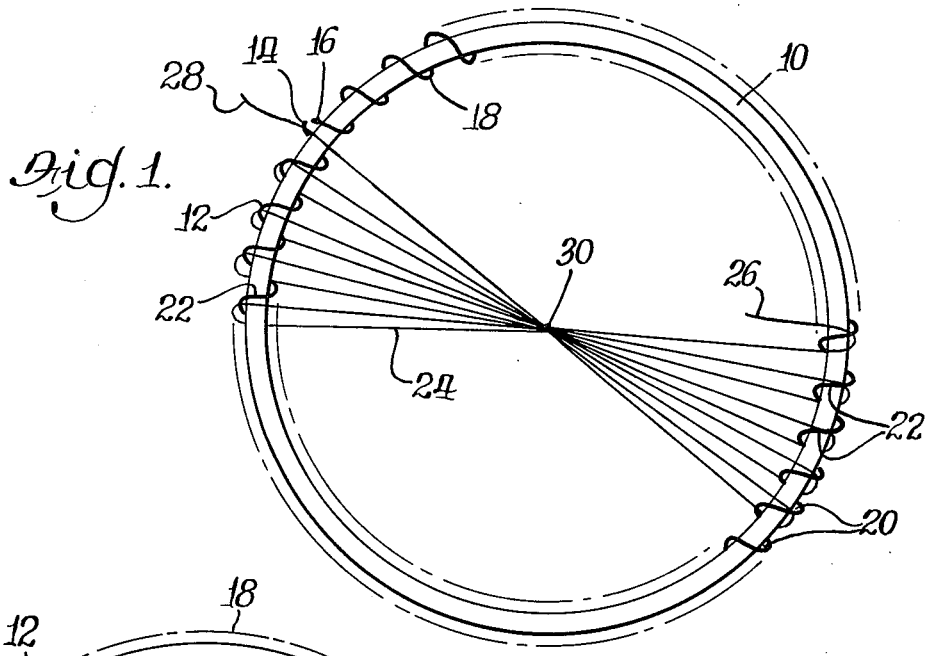
Fig. 1.
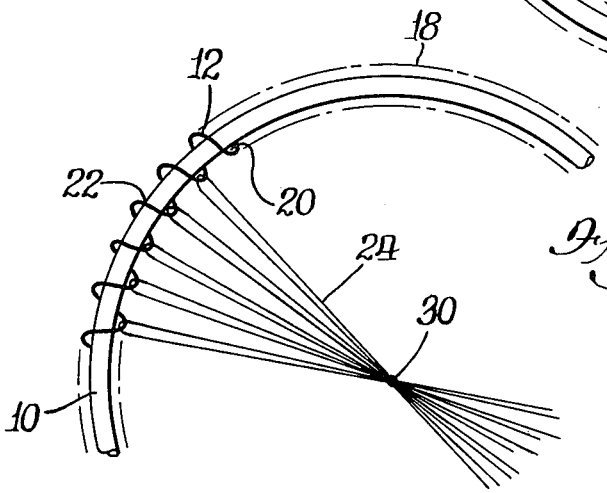
Fig. 2.
Fig. 3.
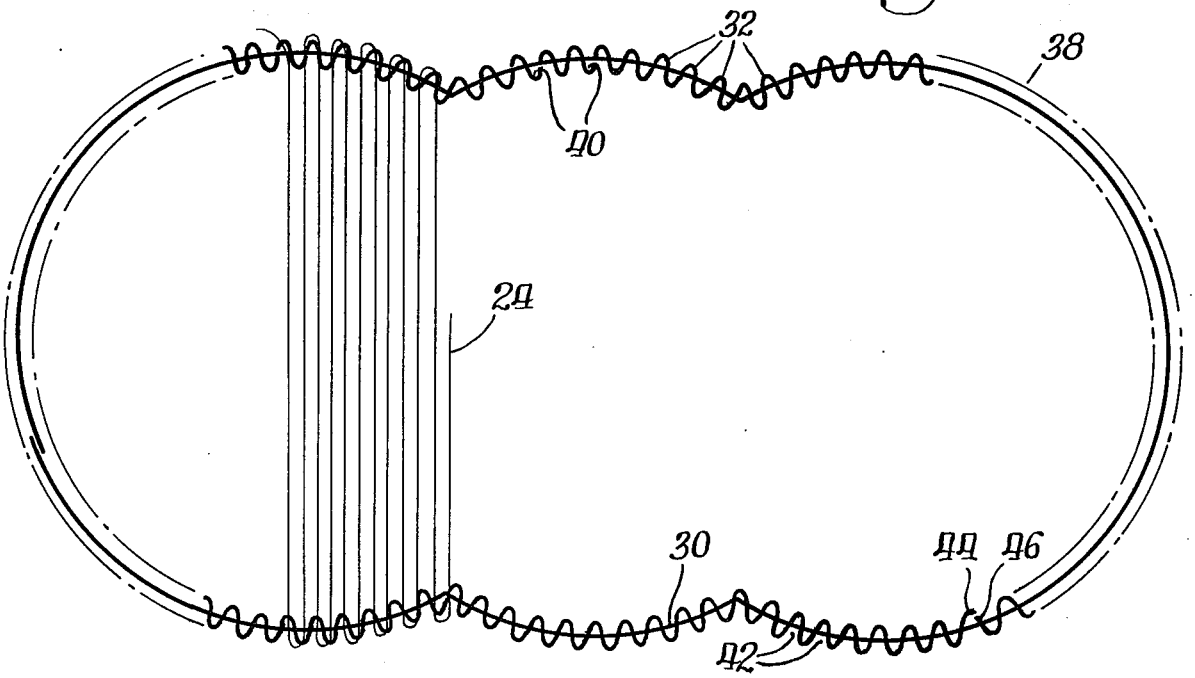

HAND LOOM CONSTRUCTION

BACKGROUND OF THE INVENTION

This invention relates generally to handweaving looms and more particularly to looms having shaped outline forms equipped with a conforming secondary frame for holding the warp yarn.

The construction of hand loom and weaving rings is a well-established art. Various techniques for securing the warp yarn to different shaped frames has been disclosed extensively in the prior art. Such previously known techniques were intended to simplify the hand weaving operation and the preparation of the woven article. One such weaving ring is disclosed in U.S. Pat. No. 1,872,281 in which the loom is made up of a pair of matingly engaged frames. One of the frames is made of rubber-like or resiliently deformable material which permits easy removal of the finished woven article. In another prior U.S. Pat. No. 2,427,093 the warp yarn is lashed about permanently fixed pegs disposed normal to a base frame for stringing the warp. Still other known frame structures have resorted to slot formations or detents in which are captured the strands of yarn such as shown in U.S. Pat. No. 983,764. Certain of the well-known frames are collapsable and extendable, somewhat like a telescope, permitting different geometric formations and being equipped with extending pegs about which the warp is stretched such as described in U.S. Pat. No. 2,780,854.

The aforedescribed hand looms do not satisfy the requirements of greater versatility in being able to be formed into different shapes and because of the manner in which the warp yarns are disposed detract from the esthetics of the finished woven article denying its use, frame and all, as a decorative article. Furthermore, the previously known techniques by which the warp yarn is stretched about the frame is for the most part, fixed in position and not readily adjustable once the weft yarn is imparted to the loom.

As a decorative woven article, the known hand looms do not readily lend themselves to a variety of differently shaped forms thereby limiting the article to a simple geometric outline at best.

SUMMARY OF THE INVENTION

A wide range of differently shaped forms can be prepared on the hand loom of this invention where the loom itself becomes a part of the decorative article. It has been found that a base frame formed, for example, of a metal rod can be shaped into a wide range of outlines including geometric as well as free forms, or in the outline of animal figures, flowers and the like. Encircling the base frame is a secondary frame comprising a generally helically coiled wire.

It is a general object of this invention to provide a hand loom of simplified construction that produces a wide variety of decorative woven articles and in which the frame becomes part of the finished article.

It is a specific object of this invention to provide a hand loom adapted to be formed into a variety of decorative woven articles, having a variety of artistical functional outline shapes and equipped with a secondary frame for adjustably holding and retaining the warp yarn.

It is a still further object of this invention to provide a simplified hand loom construction which can be formed into a variety of outline shapes and which is equipped with a secondary frame to maintain the desired tension of the warp threads and to permit any necessary adjustments of the warp thread or yarn spacing, so that both the warp yarn and the weft yarn can be adjusted as the weaving operation proceeds on the loom.

BRIEF DESCRIPTION OF THE DRAWING

FIG. I is a schematic illustration showing hand loom of this invention in a circular shape with the warp yarn applied diametrically to the loom;

FIG. II illustrates the technique of applying the warp yarn through the secondary frame coils;

FIG. III is a schematic representation showing another embodiment of the invention in which the hand loom is of a geometric shape formed by the intersecting arc of circles.

DETAILED DESCRIPTION OF THE INVENTION

Referring to I there is shown a base frame 10 which is formed into the shape of a circle. It will be appreciated that the base frame 10 may be made of a variety of materials such as metal, wood or plastic. In a case where the material is metal suitable rod stock made of brass, aluminum or steel may be used. The non-metallic materials may be plastics, acrylics, polystyrenes, or polyacrylates. Wood may also be used to good advantage. The material of construction of the base frame lends itself to having a cross-sectional configuration other than circular, such as rectangular, square and oval.

Encircling the base frame is a helical coil 12 of spring steel wire which is pre-coiled and easily wrapped around the base frame 10. This can be accomplished by forcing the free end (FIG. I) 14 of the coil over the frame 10 and thereafter entwining each coil about the frame until it circumferentially encircles the frame so that the other free end 16 of the coil 12 meets the first free end 14. Because of the springlike properties of the coil 12 the two free ends are urged into interlocking relationship with one another. It has been found that such interlocking of the free ends is sufficient to maintain the helical coil 12 in wrapped around position about the base frame.

Optionally the two free ends 14 and 16 may be welded to one another or, they may be secured to the base frame 10. It will be appreciated that it is not critical as to the manner of how the two free ends 14 and 16 are dealt with either in relationship to one another or with respect to the base frame.

The helical coil 12, as it is wrapped around the base frame 10, both radially and circumferentially, forms a secondary frame 18. The individual coils 20 (FIG. I) extend beyond the surface of the base frame 10 forming a stop 22. It will be appreciated therefore that at the point where each coil 20 encircles the base frame there is formed a stop 22.

It will be appreciated that the secondary frame 18 is, ostensively, in floating relationship to the base frame 10 and hence the location of the stop 22 can be varied with respect to the base frame 10 by merely adjusting and moving the resilient coils thereabout.

To use the hand loom requires only to stretch the warp yarn 24 about the frame 10 as shown in (FIG. I) so that it engages each of the stops 22. The warp yarn can be easily framed by securing one end 26 of the yarn to the frame 10 and then simply wrapping the yarn diametrically about each of the stops 22. This procedure produces a warp pattern similar to the spokes of a bicycle wheel. To complete the warping, the tail end 28 of the yarn is likewise secured to the frame.

At the option of the weaver, the various strands of the warp yarn meet at the center 30 of the frame 10. At the option of the weaver the insertion weft threads can begin at the center and the weaving operation proceed in a direction from the center 30 outward to the direction of the base frame 10. As a further option the weaver may commence the weaving by inserting the weft threads around the outside perimeter of the circle and commence the pattern in a direction toward the center 30. The frame with the warp yarn is now ready for weaving with any type of weft yarn, in accordance with the various options for commencing the weaving operation as described here and above.

The frame, with the warp yarn is ready for the weaving operations to be commenced with any type of weft yarn and to form the desired decorative pattern. It is only within the limits of the imagination of the weaver himself as to what type of design can be imparted to the loom. Any of the basic weaves may be employed such as: tabby, (one warp thread over and one warp thread under) twill (over two warp threads and under two warp threads), or sateen (over three warp threads and under one warp thread). Other less conventional techniques may also be used such as laid-in tapestry weaves, Ghiordes knots, soumak, twining, wrapping, binding, etc., may be readily adapted as weaving techniques for use on the hand loom of this invention.

Referring now to FIG. II there is shown an alternative technique, whereby the warp yarn 24 may be applied by hooking it through a coil 20 rather than wrapping it about the stop 22 as shown in (FIG. II).

Referring to the FIG. III, there is shown another embodiment of this invention in which the base frame 30 is formed into a geometric design produced by the intersection of arcs. The helical coil 32 which encircles the base frame 30, both radially and circumferentially, forms a secondary frame 38. The individual coils 40 extend beyond the surface of the base frame 30 forming a stop 42. As described in connection with FIG. I, the stop 42 is that location between individual adjacent coils 32 which forms a stop where the strand of yarn is held in an adjustable or movable relation to the base frame 32.

The secondary frame 38, as in the case of the secondary frame 18 (FIG. I) is secured by the interlocking relationship of the free ends of the coil 44 and 46. AS wil be appreciated, the secondary frame 38, is fully movable and adjustable about the base frame 30, but it cannot easily be dislodged from the base frame.

As desrcibed in connection with the structure of FIG. I the free ends 44 and 46, likewise, may be welded directly to the base frame 30 or to each other. The resiliency of the coil will still permit a significant amount of adjustment of the secondary frame about the base frame while assuring a fixed relationship between the base and secondary frames.

In order to accomplish the weaving operation itself a wide variety of simple tools may be used such as a tapestry needle but the warp yarn can just as easily be manipulated by hand and the weft threads may be beaten into place by a small comb made of wood, metal or plastic or even through the use of such a common instrumentality as the table fork.

It is not the intent in describing this invention to teach the art of weaving. This art, and the various techniques involved, is well established and developed and need not be set forth in detail here. However, it will be appreciated that the unique hand loom of this invention will enable even the most amateur of weavers or the most experienced to give vent to his imagination in terms of a wide variety of designs that can be produced on this hand loom. This unique and novel floating characteristics of the secondary frame suprisingly permits the weaver to manipulate the warp yarn as the weaving proceeds across the loom when the weft yarn is being inserted so that the design can be shaped and formed as the final weave proceeds.

The hand loom of this invention is quite simple but in its simplicity it provides a broad spectrum of weaving design limited only by the artistic and imaginative capabilities of the weaver.

What is claimed is:

1. In a hand loom construction for receiving strands of yarn, the combination comprising; a rigidly closed base frame having a given perimeter outlining and enclosing an area which is to receive said strands of yarn, a secondary frame adjustably disposed relative to said base frame comprising a resilient wire-like strand encircling said base frame forming a series of helical loops disposed circumferentially about and having a perimeter that at least conforms to the perimeter of said base frame and wherein said base and secondary frame coact to provide holding means for stretchably and adjustably supportng said strands of yarn within said enclosed frame area.

2. The hand loom as claimed in claim 1 wherein said base frame has a circular shape.

3. The hand loom as claimed in claim 1 wherein said yarn is stretched diametrically across said frame each strand passing through the geometric center of the frame.

4. The hand loom as claimed in claim 1 wherein said strands of yarn are stretched between opposite sides of the base frame so that the strands are generally parallel to one another.

* * * * *